US006408770B1

(12) United States Patent
Mason

(10) Patent No.: US 6,408,770 B1
(45) Date of Patent: Jun. 25, 2002

(54) ADJUSTABLE PALLET PROTECTOR ASSEMBLY FOR A SINGLE PALLET OR AN ARRAY OF PALLETS

(75) Inventor: Allen Mason, Palm Beach, FL (US)

(73) Assignee: Food Machinery Equipment Corporation, Palm Beach, FL (US)

( * ) Notice: Subject to any disclaimer, the term of this patent is extended or adjusted under 35 U.S.C. 154(b) by 0 days.

(21) Appl. No.: 09/808,916

(22) Filed: Mar. 15, 2001

(51) Int. Cl.[7] ..... B65D 19/44
(52) U.S. Cl. ..... 108/54.1; 108/56.3
(58) Field of Search ..... 108/51.11, 57.1, 108/52.1, 54.1, 56.3; 312/205

(56) References Cited

U.S. PATENT DOCUMENTS 2,942,827 A * 6/1960 Edson ..... 108/54.1
4,292,899 A 10/1981 Steffen
4,715,294 A 12/1987 Depew
5,076,175 A 12/1991 Whatley, II
5,673,629 A 10/1997 Ginnow
6,192,807 B1 2/2001 Mason

* cited by examiner

*Primary Examiner*—Peter M. Cuomo
*Assistant Examiner*—Jerry A. Anderson
(74) *Attorney, Agent, or Firm*—Caesar, Rivise, Bernstein, Cohen & Pokotilow, Ltd.

(57) ABSTRACT

A pallet protector assembly for use with one or an array of plural conventional pallets. The pallet protector assembly comprising plural, e.g., at least four, elongated bar-like, hollow plastic, guard members. Each guard member is composed of a first section and a second, with each section having an exposed end portion. The first and second sections of each guard member are telescopically slidably coupled together, whereupon the length of the guard member can be adjusted. The first end portion of the first section includes a first connector, e.g., a male member. The second end portion of the second section includes a second connector, e.g., a mating female connector. The connectors of each of the guard members are arranged to be releasably securable to the connectors of the other guard members form a self-supporting frame for encircling the periphery of the pallet(s), with the guard members being resistant to accidental disconnection from each other.

22 Claims, 4 Drawing Sheets

ADJUSTABLE PALLET PROTECTOR ASSEMBLY FOR A SINGLE PALLET OR AN ARRAY OF PALLETS

BACKGROUND OF THE INVENTION

This invention relates generally to pallets for supporting materials, and more particularly to an expandable protector assembly which is arranged to be readily disposed about the periphery of a pallet of various sizes or an array of plural of pallets to protect the pallet(s) and persons coming into contact with the pallet(s).

In U.S. Pat. No. 4,715,294 (Depew) there is disclosed a pallet construction making use of protective members fabricated out of metal, plastic or other impact resistant material for engaging two opposed end portions of the pallet to protect against damage. The protective members are in the form of upper and lower elongated bars and associated cap portions. The protective members are arranged to be secured in place to the pallet, via nails or screws, with the bars extending flush with the top and bottom surfaces of the upper and lower deck-boards, and with the cap portions embracing the end portions of the stringers or other deck-board supporting components. The cap portions are secured to the embraced portions beneath the deck-boards. Flanges may be provided on the cap portions at the end of the protective members for direct securement to the upper surface of the deck-boards and to the under surface of the underlying portion of the pallet. With pallets of block type construction, side protective members may be included to be nailed, screwed or otherwise secured to sides of the pallet, whereupon the periphery of the pallet is protected.

While the pallet protective members of the Depew patent may be generally suitable for their intended purposes of protecting the pallet from damage by a fork-lift apparatus used to lift and transport the pallet, they still leave much to be desired from various standpoints, e.g., inability to cover the entire periphery of the pallet, complexity of construction, inability to be readily removed from the pallet.

Other pallet protectors have been disclosed in the patent literature. For example, U.S. Pat. No. 4,292,899 (Steffen) discloses a protective element for a pallet in the form of a plate, preferably formed of sheet metal for a fixation to deleting stringer of the pallet. The plate-like element is preferably nailed to the pallet.

U.S. Pat. No. 5,076,175 (Whatley, II) also discloses a protective plate for use with a pallet. The plates may include perforations or holes to receive fasteners such as nails for fixing the plate to the pallet. The plates are disclosed as being fabricated from sheet metal.

U.S. Pat. 5,673,629 (Ginnow) discloses an end cap construction for protecting the ends of the stringers of a pallet. Each of the end cap construction units is a generally U-shaped member having plural apertures therein.

In my U.S. Pat. No. 6,192,807, there is disclosed and claimed a pallet protector assembly which overcomes many of the disadvantages of the prior art. That pallet protector assembly is arranged for use with a conventional pallet, e.g., a wooden pallet having a plurality of stringers disposed generally parallel to one another between upper and lower decks formed of plural spaced-apart deck-boards. The pallet has a pair of sides and a pair of ends. The pallet protector assembly comprising plural, e.g., four, elongated bar-like, hollow plastic, guard members, each which has an opposed pair of end portions. Each end portion of each guard member includes a respective connector. Both of the connectors of two of the guard member are bulbous key-like projections.

Both of the connectors of the other two of the guard members are mating key slot shaped recess. The bulbous key-like projections of the two guard members are arranged to be releasably received within respective recesses of the other two guard member to releasably secure the guard members to one another to form a self-supporting frame encircling the periphery of the pallet. The connectors forming the guard members are resistant to accidental disconnection from each other so that the protector assembly when in place is resistant to accidental disconnection. However, any guard member can be readily purposely removed from the others to provide access to any portion of the pallet, e.g., access to an end portion to enable the pallet to be lifted by the tines of a conventional fork-lift machine.

In my co-pending U.S. patent application Ser. No. 09/519,300, filed on Mar. 6, 2000, entitled Protector for an Array of Pallets there is disclosed and claimed a pallet protector assembly for use with an array of pallets, e.g., at least two conventional pallets arranged in an array closely adjacent each other. Each of the pallets has a plurality of stringers disposed generally parallel to one another underneath an upper deck. The deck is formed of plural spaced-apart deck-boards. Each of the pallets also has a pair of sides and a pair of ends. The pallet protector assembly comprising at least six elongated bar-like guard members, each of which has a first end portion and a second end portion. The first end portion includes a first connector. The second end portion includes a second connector. The first connector of any one of the guard members is arranged to be releasably secured to the second connector of any other of the guard members. All of the guard members are arranged to be secured to each other to form a self-supporting frame for encircling the periphery of the array of pallets, with the guard members being resistant to accidental disconnection from each other.

While my aforementioned patent and co-pending patent application overcome many of the drawbacks of the prior art pallet protecting devices, they never the less still leave something to be desired from the standpoint of being able to be customized for size to a particular pallet or array of pallets.

Safe Strap Company, Inc. of Somersworth, N.H. has available an adjustable pallet guard assembly for use with a conventional pallet or group of pallets. This assembly consists o f plural plastic extendable side members which are arranged to be connected to each other at their respective ends to encircle a pallet. Each side member is made up of two sections, an inner section, and an outer section, which nest together and are slidable with respect to each other along their longitudinal axis so that the length of the side member can be adjusted. Each section of each side member consists of a vertical wall having a top edge from which a narrow horizontal top wall (i.e., a flange) projects and a bottom edge from which a narrow horizontal bottom wall (i.e., a flange) projects. The cross-sectional shape of each section is thus of a generally C-shape. The vertical wall forms the outer peripheral surface for the assembly when the side members are connected to each other encircling the pallet. The free or marginal edges of the upper and lower walls engage the periphery of the pallet so that there is a space between the periphery of the pallet and the inner surface of the vertical wall. In order to hold the two sections together in their nested but extendable configuration, one of the sections of each side member includes a narrow strap bridging the free marginal edge of the top and bottom walls at one end of the section to form a slot into which one end of the other (inner nested) section extends. This slot serves to guide and hold the two sections axially aligned so that they can be extended with respect to each other without substantial skewing. Since each of the side members is completely open from the inside, each is somewhat susceptible to twisting, bending and other deformation. Moreover, the open construction of the side members of the assembly provides a lesser measure of protection to the pallet from impact. Thus, while the Safe Strap, Inc. pallet guard assembly may provide some adjustability of the pallet guard members for accommodating various size pallets, it does so at the expense of ruggedness, strength, and impact resistance. Moreover, the guard members of the Safe Strap, Inc. assembly are somewhat complex in construction and are somewhat difficult to assemble and disassemble.

Accordingly a need exists for a pallet protector assembly which is simple in construction, adjustable, easy to assemble and disassembly, resistant to impact and deformation, while being suitable for use with only a single pallet of various sizes or an array of pallets.

SUMMARY OF THE INVENTION

This invention relates to an adjustable pallet protector assembly for use with at least one pallet, e.g., a single pallet or an array of plural pallets. The pallet(s) with which the subject invention may be used can be conventional, e.g, a rectangular or square shaped assembly having a pair of sides and a pair of ends, with plurality of stringers disposed generally parallel to one another underneath an upper deck, with the deck being formed of plural spaced-apart deck-boards.

The pallet protector assembly of this invention basically comprises at least four elongated guard members. Each of the guard members is composed of a first hollow section and a second hollow section, with the first section having a first end portion and the second section having a second end portion. The first and second sections are telescopically slidably coupled together, whereupon the length of each guard member can be adjusted. The first end portion of the first section and the second end portion of the second section of each guard member are exposed when the sections making up that guard member are coupled together. The first end portion of the first section includes a first connector, e.g., a male member. The second end portion of the second section includes a second connector, e.g., a female member. The connectors of all of the guard members are releasably securable to one another, e.g., the male and female members mate, to form a self-supporting frame for encircling the periphery of the pallet(s). Once so connected the guard members are resistant to accidental disconnection from one another.

In accordance with one preferred embodiment of the invention each of the guard members is formed of a light-weight, impact resistant material, such as polyethylene, polyolefin cellulose composite, or other plastics.

DETAILED DESCRIPTION OF THE PREFERRED EMBODIMENT

Referring to FIGS. there is shown at 20 a pallet protector or guard assembly constructed in accordance with this invention and shown in its assembled state mounted about the periphery of a conventional pallet 10. The assembly 20 basically comprises a modular set of components, i.e., plural guard members (to be described later) which are arranged to be releasably secured to one another to form a peripheral wall which surrounds the pallet 10. This protective wall serves various purposes. For example, when in place it protects the pallet from injury which could otherwise result from the pallet being impacted by some piece of machinery, e.g., a fork-lift truck, or other object. Moreover, the pallet protector 20 also serves to protect personnel and others in the vicinity of the pallet from being injured by contact with the pallet, e.g., being injured by a splinter from the pallet.

Figure 1:
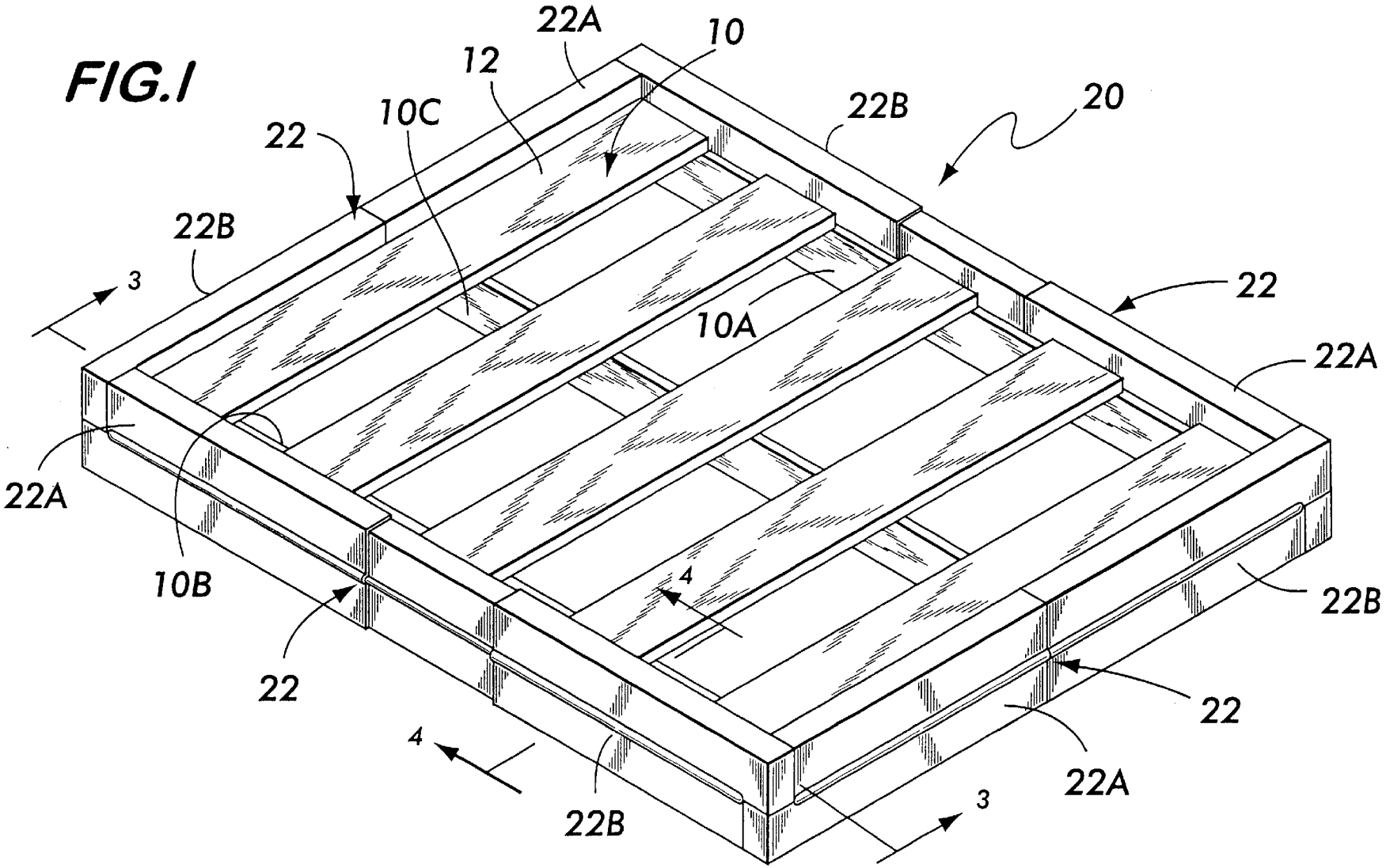
FIG. 1 is an isometric view of one exemplary embodiment of a pallet protector assembly constructed in accordance with the subject invention, this embodiment having four adjustable pallet guard members connected together, with the assembly being shown in place about the periphery of a single, conventional pallet, e.g., a single faced, flush-stringer wooden pallet.

Before discussing the pallet protector assembly 20 a brief description of the pallet 10 is in order. To that end as can be seen in FIG. 1 the pallet 10 may be of a single-face, flush-type stringer design, or a reversible or double-faced, flush-type stringer design (not shown). A single faced pallet includes plural, e.g., two, parallel outer stringers 10A and 10B, and a central stringer 10C. The three stringers are elongated bar-like members disposed parallel and equidistantly to one another. The outer stringers define the two opposed sides of the pallet, with their respective ends defining the two opposed ends of the pallet. The stringers 10A, 10B and 10C are disposed under and support an upper deck 12 made up of a plurality of spaced-apart deck-boards. The deck-boards are fixedly secured to stringers by nails, screws, or other suitable fasteners. When so connected, the upper deck and the stringers 10A, 10B and 10C cooperate to define the a pair of side-by-side, lengthwise extending, open-ended passages for receiving the tines of the fork of a fork-lift truck for facilitating load handling. In the embodiment of FIG. 1 the passageways have no bottom wall since there is no lower deck.

The pallet 10 is typically formed of wood, but may be formed of any durable, wear-resistant, load-supporting material. Examples of such other materials are plastics, metals, etc. As will be appreciated by those skilled in the art, conventional pallets 10 like those described above, while relatively low in cost and easy to fabricate, suffer from various disadvantage. The most significant disadvantages exist if the pallets are formed of wood, since such pallets tend to splinter or break relatively easily. This action may not only result in damage to the pallet to the extent at which it is no longer functional, but also could subject personnel who may come in contact with the pallet to injury from splinters. The pallet protector of this invention, while suitable for use on any type of pallet is particularly suitable for use with prior art wooden pallets to minimize, if not prevent, damage to pallet itself and to prevent splinter-induced injuries to personnel by shielding them from the sides and ends of the pallet.

The pallet protector assembly 20 of this invention basically comprises a plurality, e.g., at least four, elongated, rails or guard members. In an embodiment of the assembly for use with a single pallet 10 the assembly 20 includes four rails or guard members 22. The guard members are each of identical construction and each includes two hollow, elongated sections 22A and 22B which are arranged to be slidably coupled, e.g., telescoped, together at their inner end portions (as will be described later). This feature enables each guard member to be adjusted in size from its minimum length state up to its maximum length state. The minimum length state is shown in FIG. 1. As will be described later, in this state, the inner ends of the two sections 22A and 22B are telescoped together (overlapped) to the maximum extent possible. The maximum length state is that wherein the inner ends of the two sections 22A and 22B are telescoped together to the minimum extent possible. The two sections 22A and 22B can be adjusted to any intermediate position between the minimum overlap to the maximum overlap so that the guard member can be adjusted to any length from its maximum length to its minimum length.

Figure 2:
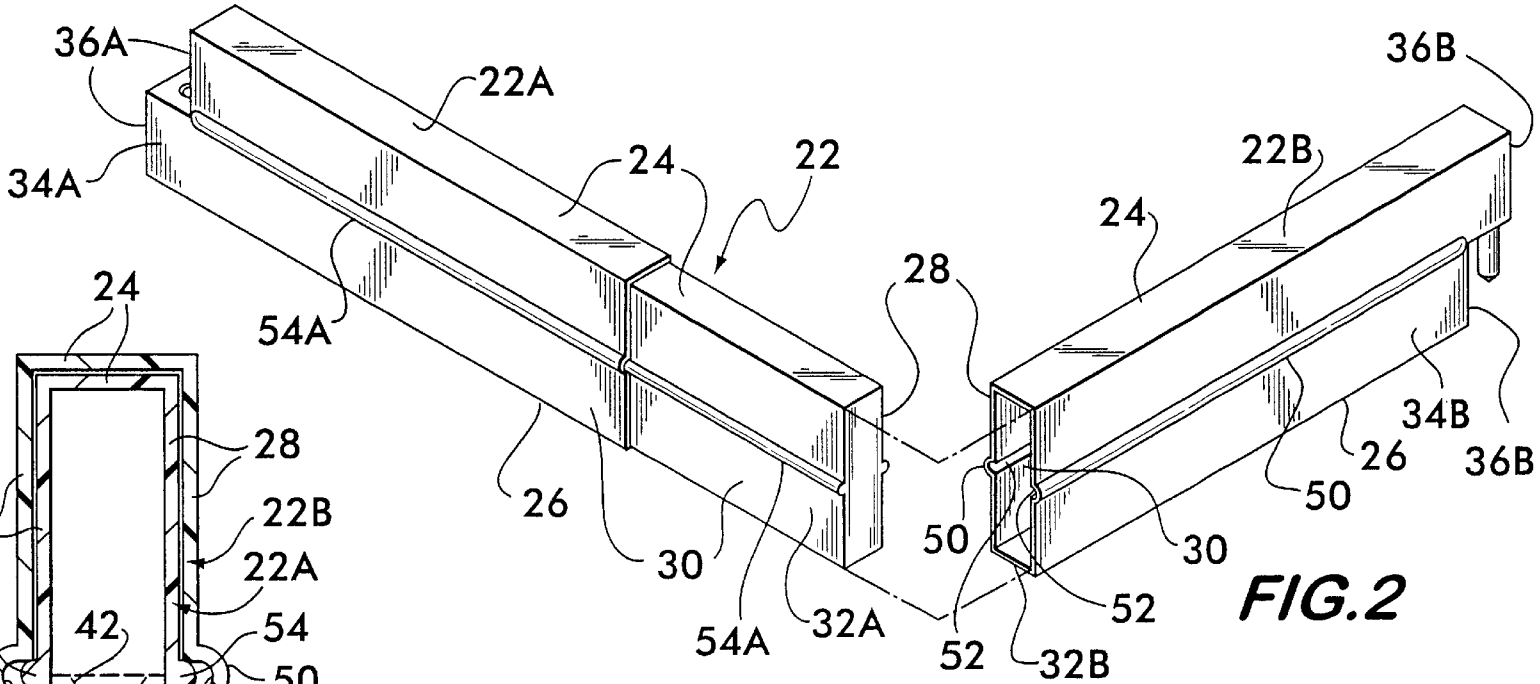
FIG. 2 is an exploded isometric view of one of the expandable pallet guard members forming the pallet protector assembly of FIG. 1.
Figure 4:
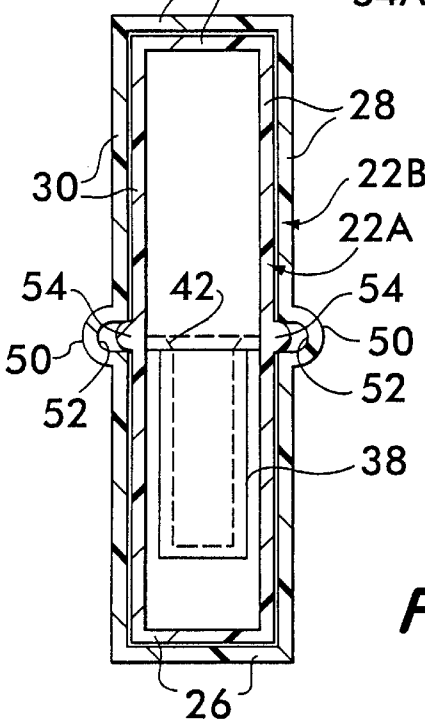
FIG. 4 is an enlarged sectional view taken along line 4—4 of FIG. 3.
Figure 3:
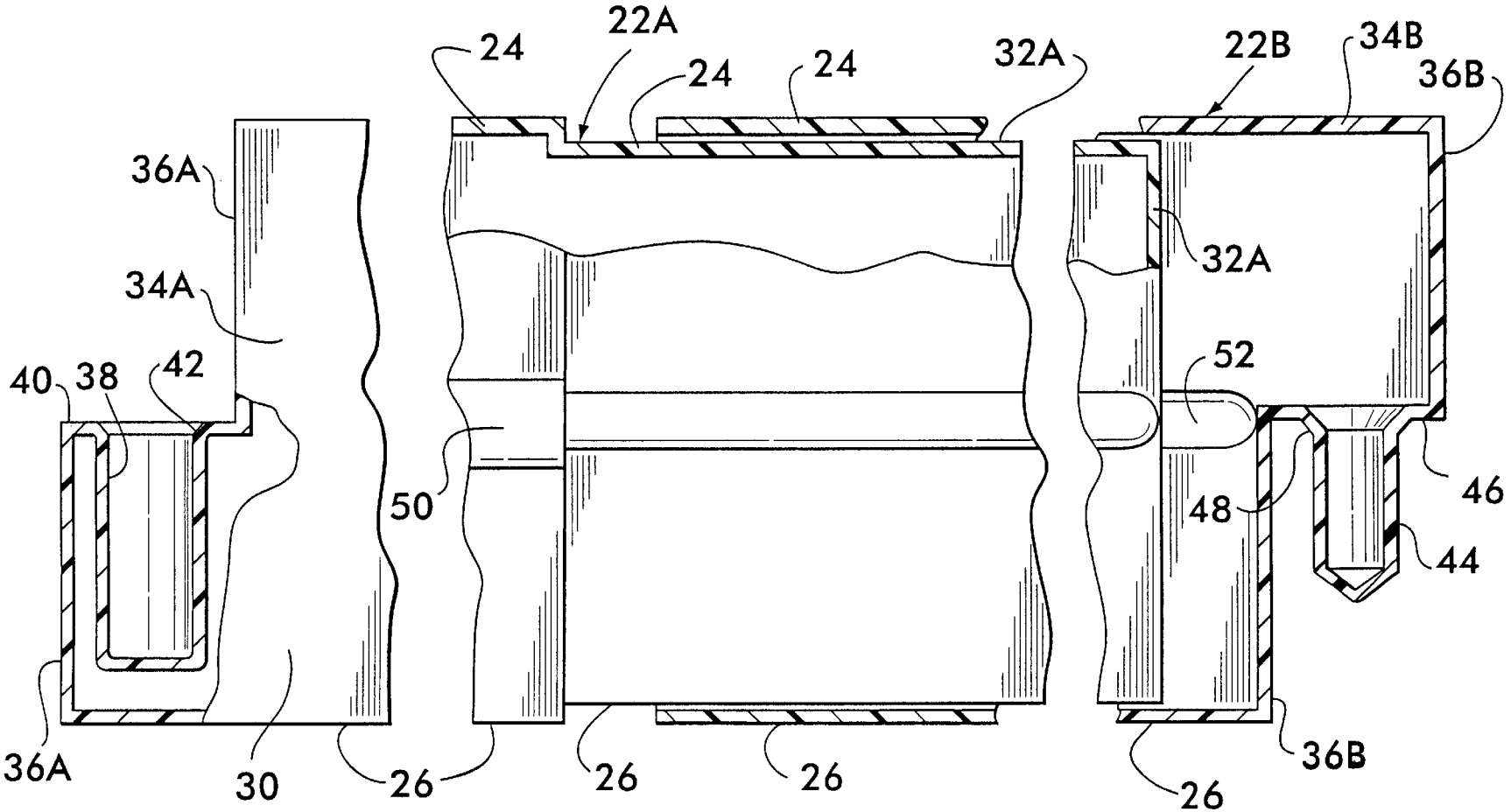
FIG. 3 is an enlarged sectional view taken along line 3—3 of FIG. 1.

As best seen in FIGS. 2–4, each of the sections 22A and 22B has a top wall 24, a bottom wall 26, an inside wall 28, an outside wall 30. All of the walls of each section extend the entire length of the section parallel to the central longitudinal axis of the section. The cross sectional shape the section 22B taken along a plane transverse to the central longitudinal axis is rectangular (see FIG. 4) and is constant along the entire length of the section. The section 22B includes an inner end portion 32B and an outer end portion 34B. The inner end portion 32B terminates at an open free end. The outer end portion terminates at a stepped closed end wall 36B. The section 22A also includes a inner end portion 32A and an outer end portion 34A. The inner end portion 32A terminates at a closed end wall (FIGS. 1 and 3). The outer end portion 34A terminates at a stepped closed end wall 36A.

The cross sectional shape the section 22A taken along a plane transverse to the central longitudinal axis is the same rectangular shape and size as the section 22B and is constant along the entire length of the section 22A except for the inner end portion 32A. To that end, the inner end portion 32A is rectangular but of a slightly lesser size to enable the inner end portion of section 22A to be slidably received closely within the inner end portion of section 22B as best seen in FIGS. 3 and 4. In particular, the distance between the outer surface of the inner wall 28 and outer surface of the outer wall 30 at the inner end portion 32A of the section 22A is just slightly less than the distance between the inner surface of the inner wall 28 and the inner surface of the outer wall 30 of the section 22B. Similarly, the distance between the outer surface of the top wall 24 and outer surface of the bottom wall 26 at the inner end portion 32A of the section 22A is just slightly less than the distance between the inner surface of the top wall 24 and the inner surface of the bottom wall 26 of the section 22B.

When the inner end 32A of the section 22A is located within the inner end 32B of the section 22B and at its deepest penetration, i.e., the orientation wherein the length of the section 22 is the shortest, the outer surfaces of all of the walls of the section 22A are flush with the outer surfaces of the corresponding walls of the section 22B as shown clearly in FIGS. 1 and 3.

Each of the sections 22A and 22B can be formed of any suitable material, two particularly suitable ones being polyethylene and polyolefin cellulose composite, but other plastics or other non-plastic materials can be used as well so long as they are somewhat light in weight, durable, and impact resistant.

Each of the guard members 22 is arranged to be located on a respective side or end of the pallet when the assembly is used with only a single pallet, like shown in FIG. 1. The two sections making up each guard member can be adjusted with respect to each other to customize the length of the guard member to that of the size of the side or end of the pallet along which the pallet guard will extend. The guard members are arranged to be connected together at their respective ends 36A and 36B, as will be described in detail later.

In one commercial exemplary embodiment of this invention each of the guard members is dimensioned so that it's minimum length as measured along its longitudinal axis is approximately 38.5 inches (97.8 cm) while its maximum length is approximately 58.5 inches (148.6 cm). The thickness, i.e., the distance between the outer surface of the inner wall 28 and the outer wall 30 of all of the guard members in the exemplary commercial embodiment is 1.5 inches (3.8 mm). The height, i.e., the distance between the outer surface of the top wall 24 and the outer surface of the bottom wall 26, of all of the guard members in the exemplary commercial embodiment is 6 inches (15.2 cm), so that each guard member's height is at least equal to the thickness of the pallet. It should be pointed out that such a construction is merely exemplary. Thus, in some cases it may be desirable to utilize guard members of a greater height than the height of the pallet, in some cases it may be desirable to utilize guard members of the same height as the pallet, and in other cases it may be desirable to utilize guard members of a lower height as the pallet. Moreover, the guard members may be of other maximum and/or minimum lengths, as desired.

Each of the guard members is arranged to be releasably secured to two other guard members at its ends so that all of the guard members can be connected to one another to form a hollow rectangular frame for encircling the periphery of the pallet 10 or of an array of pallets (as will be described later). To that end, as best seen in FIG. 3, the outer end of the section 22A of each guard member includes a respective female connector element in the form of a cylindrical hole or bore 38 located on a ledge 40 forming a portion of the stepped end wall 36A. The entry point of the bore 38 is chamfered at 42 to facilitate entry of a male connector element (to be described hereinafter) forming a portion of another guard member. The outer end of the section 22B of each guard member includes a male connector element in the form of a cylindrical pin 44 located on a ledge 46 forming a portion of the stepped end wall 36B, as best seen in FIG. 3. The pin 44 terminates in a tapered free end 48 and is of substantially the same outside diameter as the inside diameter of each of the female connector elements or bores 38 to enable any pin 44 to be matingly received therein to releasably connect the two guard members composed of those mating connector members to each other to form a rectangular, self supporting frame assembly. The root of each pin 44 is a conical wall 48 which is arranged to mate with the chamfer 42 of the bore 38 when the pin 44 is fully within the bore.

The pin 44 of each guard member 22 has a longitudinal axis extending through it. That axis is perpendicular to the guard member's top and bottom walls and is also perpendicular to the plane of the pallet's upper deck 12. Each bore 38 of the guard members 22 also has a longitudinal axis extending through it. That axis is also perpendicular to the guard member's top and bottom walls and is perpendicular to the plane of the upper deck of the pallet. Thus, the pin 44 of one guard member 22 can be readily matingly releasably secured in the bore 38 of another guard member 22 by merely moving the two connector elements toward each other along their respective axes and with those axes being axially aligned until the pin 44 is fully within the bore 38. When so disposed the two mating connectors elements 38 and 44 are resistant to accidental disconnection in a direction parallel to the longitudinal axis of either of the guard members. However, the two connector elements 38 and 44 can be readily disconnected from each other to disconnect the guard members 22 by moving them away from each other in opposite directions along their co-aligned axes until the pin 44 is free from the bore 38. All of the other mating connector elements of the other guard members can be readily connected and disconnected in a similar manner.

When the guard members are connected as just described they form a rectangular, self supporting frame assembly. Moreover, as discussed above the guards members are dimensioned such that the spacing between the interior walls 28 of the guard members 22 is slightly greater to the spacing between the ends/sides of the pallet, whereupon those interior walls 28 are spaced from the periphery of the pallet. Thus, when the guards are connected as just described they completely encircle and cover the ends and sides of the pallet, thereby protecting the pallet from impact-induced damage. If the pallet is formed of wood or some other material which may tend to splinter, the assembled protector assembly will prevent any person from coming in contact with the sides or ends of the pallet, thereby protecting the person from being injured by a splinter from the pallet.

In order to strengthen each guard member and to ensure that when assembled the guard member is resistant to bending or other deformation each of the inner and outer walls 28 and 30, respectively, of the section 22B include a longitudinally extending ridge/groove 50 extending virtually the entire length of the section halfway between the top and bottom walls 24 and 26, respectively. The inside surface of the ridge/groove 50 forms a track 52 for receipt of a ridge 54 of the section 22A. The ridge 54 extends along the outer surface of the inside and outside walls 28 and 30, respectively, of the section 22A and is located halfway between the top and bottom walls, 24 and 26, respectively, of that section. Each ridge 54 includes two portions, one portion 54A extending the length of the inner end portion 32A of each of the inner and outer walls 28 and 30, respectively, making up that portion. The radius of curvature of the ridge portion 54A is sufficiently small to enable it to fit within the groove 52 of the ridge/groove 50 in the inner and outer walls 28 and 30, respectively, of the section 22B. The radius of curvature of the remaining portion of the ridge 54 (that is the portion not making up the inner end portion 32A) is the same as that of the outer surface of the ridge/groove 50 of the section 22B.

Each ridge portion 54A is arranged to be received within a respective groove 50 of the inside and outside walls of the section 22B to help guide the sliding of the two sections with respect to each other. Like the ridges 50, the ridges 54 provide resistance to deformation of the section 22A.

In order to provide access to either end of the pallet to expose it's tine receiving open-ended passages 18 so that the tines of the fork of a fork-lift truck or a pallet jack may be inserted therein to lift or otherwise move the pallet, either of the guards 22 located across the respective ends of the pallet can be readily removed, leaving the remaining guards assembled, if desired. In particular, to remove one of the guard members all that is necessary is to lift upward on one end of the guard member parallel to the axis 44 of the mating male and female connector elements at one end of the guard member to be removed to free the male connector element from its mating engagement with the female connector element of the guard 22 to which it had been releasably secured. The connection at the other end of the guard member to be removed is disconnected in a similar manner. Once the connectors are free from their mating engagement the guard 22 can be removed laterally, thereby leaving either the desired end of the pallet exposed. The pallet can then be lifted by the fork lift.

It should be pointed out at this juncture that the pallet protector assembly of this invention can be constructed so that each of its guard members includes a male connector element at one end and a female connector element at the other, each of which is arranged for releasably connection to a mating connector element of another guard member. However, the male connector may be located at section 22A instead of 22B and the female connector may be located at section 22B instead of 22A. Moreover, the guard members may all be of the same dimensions or some can be of greater or short length, notwithstanding their adjustability. Thus, it should be clear that the size and shape of the guard members making up the pallet protector of this invention is a matter of choice. Moreover, the pallet protector or any portion of it can be colored or provided with suitable indicia to serve as some identification means, e.g., the guards can be colored to identify a particular department for which the pallet is to be used or to identify the material stored on the pallet.

Figure 5:
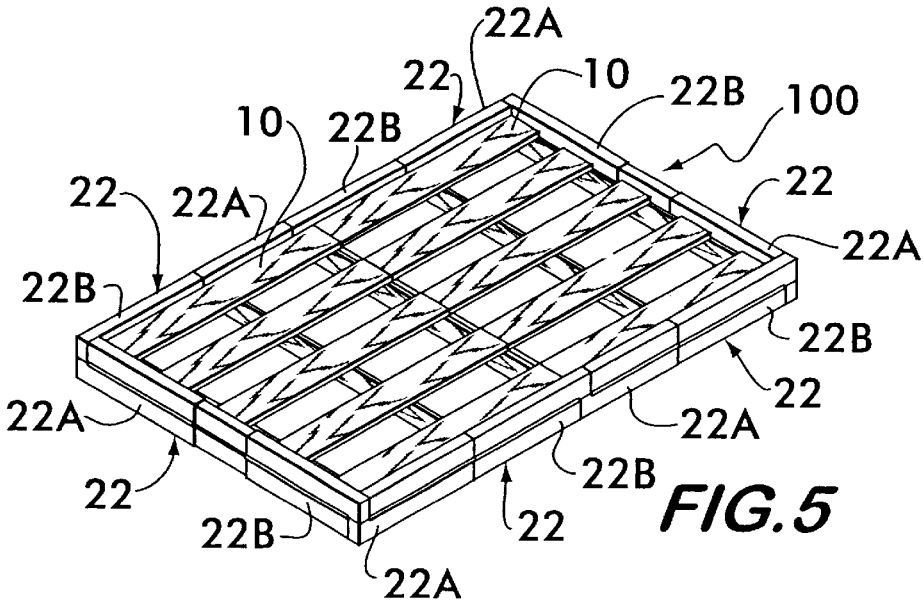
FIG. 5 is a reduced isometric view of another exemplary embodiment of a pallet protector assembly constructed in accordance with this invention, with this embodiment including six adjustable pallet guard members connected together in place about the periphery of a side-by-side array of two conventional pallets.
Figure 6:
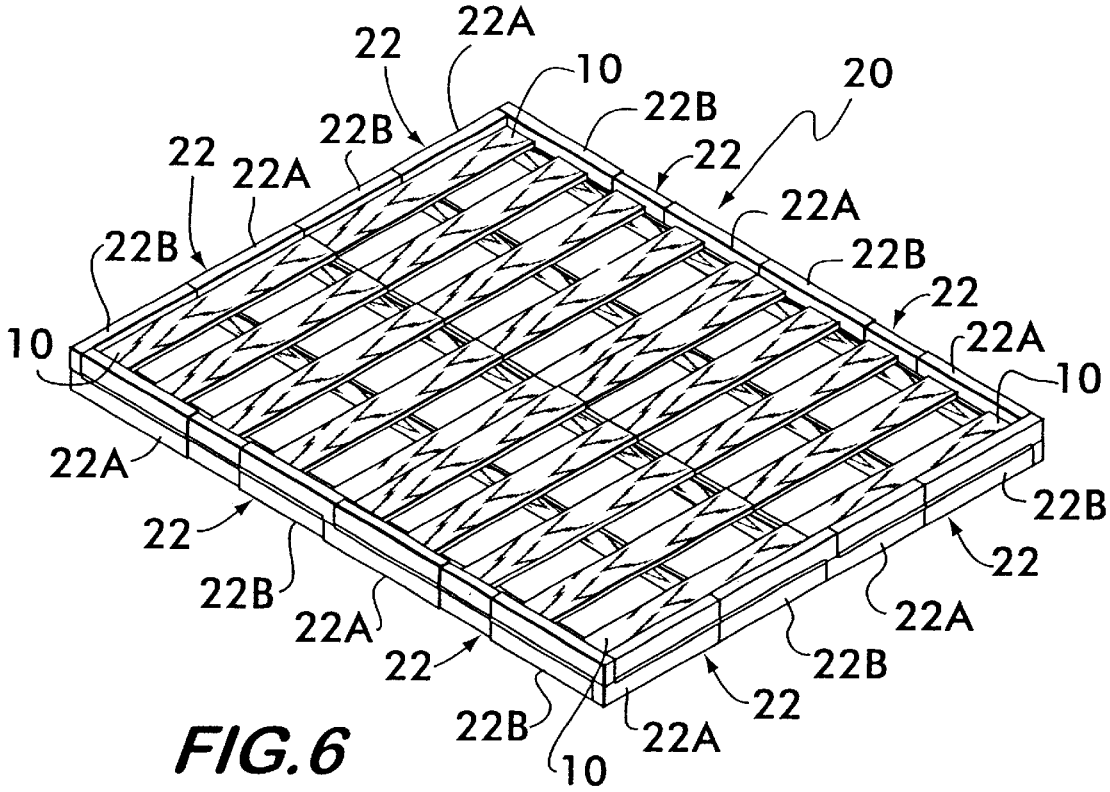
FIG. 6 is a reduced isometric view of still another exemplary embodiment of a pallet protector assembly constructed in accordance with this invention, with this embodiment including eight adjustable pallet guard members connected together in place about the periphery of a four-by-four array of conventional pallets.

In FIGS. 5 and 6 there are shown two other embodiments of the pallet protector assembly of this invention shown disposed about and protecting an array of pallets. In particular, in FIG. 5, there is shown a pallet protector assembly 100 made up of six guard members 22, each of which is constructed identically to the embodiment of FIG. 1. This assembly extends about a side-by-side array of two pallets 10. Thus, as can be seen, two guard members 22 are located at respective opposite sides of the side-by-side pallet array. Two guard members 22 are connected together and oriented co-linearly with respect to each other to form a double length side for the pallet protector assembly 100 to protect the contiguous adjacent ends of the array of pallets 10. Another two guard members 22 are connected together in a similar manner to protect the opposite contiguous adjacent ends of the array of pallets.

In FIG. 6 there is shown a pallet protector assembly 200 for protecting a two-by-two array of pallets 10. The assembly 200 consists of eight guard members 22, with two guard members 22 being connected together co-linearly to extend along a respective side or end of the array, with another two co-linearly connected guard members extending along another side or end of the array, and so on.

It should be noted that the pallet protector assemblies of this invention can be used to protect a single pallet or an array of plural pallets, with the number of guard members being dependent on the number of pallets in the array.

As should be appreciated from the foregoing the pallet protector assembly of this invention is simple in construction, can be manufactured at low cost, can be readily assembled and disassembled without the need for any tools, is light weight and readily transportable, and should exhibit a long life. Moreover, and quite significantly, the length of each guard member of the assembly can be adjusted to accommodate various sizes of pallets. Thus, by establishing an adjustable surrounding frame for any pallet or group of pallets the pallet protector assembly of this invention serves to protect employees and customers from injuries related to exposed wood splinters while also preventing or minimizing damage to the pallet(s). Moreover, the clean lines of the assembled pallet protector assembly should serve to dress up unsightly conventional wood pallets.

Without further elaboration the foregoing will so fully illustrate my invention that others may, by applying current or future knowledge, adopt the same for use under various conditions of service.

I claim:

1. An adjustable pallet protector assembly for use with at least one pallet, said pallet protector assembly comprising at least four elongated, similarly shaped guard members, each of said guard members comprising a first hollow section and a second hollow section, said first hollow section having an inner wall having a generally planar outer surface, a bottom wall having a generally planar outer surface and a first end portion, said second hollow section having an inner wall having a generally planar outer surface, a bottom wall having a generally planar outer surface and a second end portion, said first and second sections being telescopically slidably coupled together, whereupon the length of said guard member can be adjusted, said first end portion of said first section including a first connector, said second end portion of said second section including a second connector, said connectors of said guard members being releasably securable to one another to form a self-supporting frame for encircling the periphery of the at least one pallet, with said inner walls of said guard members being disposed closely adjacent the at least one pallet, with said bottom walls of said guard members being arranged to be located on a support surface and with said guard members being resistant to accidental disconnection from each other.

2. The pallet protector assembly of claim 1 wherein each of said sections of each of said guard members includes a longitudinally extending rib.

3. The pallet protector assembly of claim 1 wherein each of said guard members is formed of a light-weight, impact resistant material.

4. The pallet protector assembly of claim 3 wherein said material comprises a plastic.

5. The pallet protector assembly of claim 4 wherein said plastic is polyethylene.

6. The pallet protector assembly of claim 4 wherein said plastic is polyolefin cellulose composite.

7. The pallet protector assembly of claim 1 wherein each of said guard members includes a top surface and a bottom surface, and wherein said first end portion includes a notch therein and said second end portion includes a notch therein, said notch of said first end portion of any of said guard members being arranged to mate with said notch of said second end portion of any other of said guard members.

8. The pallet protector assembly of claim 1 wherein said first connector comprises a male member and wherein said second connector comprises a female member.

9. The pallet protector assembly of claim 7 wherein said first connector comprises a male member, wherein said second connector comprises a female member, wherein said male member is located at one of said notches and said female member is located at the other of said notches.

10. In combination at least one pallet and a protector assembly therefore, said pallet protector assembly comprising at least four elongated, similarly shaped guard members, each of said guard members comprising a first hollow section and a second hollow section, said first section having an inner wall having a generally planar outer surface, a bottom wall having a generally planar outer surface and a first end portion, said second section having an inner wall having a generally planar outer surface, a bottom wall having a generally planar outer surface and a second end portion, said first and second sections being telescopically slidably coupled together, whereupon the length of said guard member can be adjusted, said first end portion of said first section including a first connector, said second end portion of said second section including a second connector, said connectors of said guard members being releasably securable to one another to form a self-supporting frame for encircling the periphery of said at least one pallet, with said inner walls of said guard members being disposed closely adjacent the at least one pallet, with said bottom walls of said guard members being arranged to be located on a support surface and with said guard members being resistant to accidental disconnection from one another.

11. The pallet protector assembly of claim 10 wherein each of said sections of each of said guard members includes a longitudinally extending rib.

12. The pallet protector assembly of claim 10 wherein each of said guard members is formed of a light-weight, impact resistant material.

13. The pallet protector assembly of claim 12 wherein said material comprises a plastic.

14. The pallet protector assembly of claim 13 wherein said plastic is polyethylene.

15. The pallet protector assembly of claim 13 wherein said plastic is polyolefin cellulose composite.

16. The pallet protector assembly of claim 10 wherein each of said guard members includes a top surface and a bottom surface, and wherein said first end portion includes a notch therein and said second end portion includes a notch therein, said notch of said first end portion of any of said guard members being arranged to mate with said notch of said second end portion of any other of said guard members.

17. The pallet protector assembly of claim 10 wherein said first connector comprises a male member and wherein said second connector comprises a female member.

18. The pallet protector assembly of claim 16 wherein said first connector comprises a male member, wherein said second connector comprises a female member, wherein said male member is located at one of said notches and said female member is located at the other of said notches.

19. An adjustable pallet protector assembly for use with at least one pallet, said pallet protector assembly comprising at least four elongated guard members, each of said guard members comprising a first hollow section and a second hollow section, said first hollow section having a first end portion, said second hollow section having a second end portion, said first and second sections being telescopically slidably coupled together, whereupon the length of said guard member can be adjusted, each of said guard members including a top surface and a bottom surface, and wherein said first end portion includes a notch therein and said second end portion includes a notch therein, said notch of said first end portion of any of said guard members being arranged to mate with said notch of said second end portion of any other of said guard members, said first end portion of said first section including a first connector, said second end portion of said second section including a second connector, said connectors of said guard members being releasably securable to one another to form a self-supporting frame for encircling the periphery of the at least one pallet, with said guard members being resistant to accidental disconnection from each other.

20. The pallet protector assembly of claim 19 wherein said first connector comprises a male member, wherein said second connector comprises a female member, wherein said male member is located at one of said notches and said female member is located at the other of said notches.

21. In combination at least one pallet and a protector assembly therefore, said pallet protector assembly comprising at least four elongated guard members, each of said guard members comprising a first hollow section and a second hollow section, said first section having a first end portion, said second section having a second end portion, said first and second sections being telescopically slidably coupled together, whereupon the length of said guard member can be adjusted, each of said guard members includes a top surface and a bottom surface, and wherein said first end portion includes a notch therein and said second end portion includes a notch therein, said notch of said first end portion of any of said guard members being arranged to mate with said notch of said second end portion of any other of said guard members, said first end portion of said first section including a first connector, said second end portion of said second section including a second connector, said connectors of said guard members being releasably securable to one another to form a self-supporting frame for encircling the periphery of said at least one pallet, with said guard members being resistant to accidental disconnection from one another.

22. The pallet protector assembly of claim 21 wherein said first connector comprises a male member, wherein said second connector comprises a female member, wherein said male member is located at one of said notches and said female member is located at the other of said notches.

* * * * *